US012799731B2

(12) United States Patent
Rompel

(10) Patent No.: US 12,799,731 B2
(45) Date of Patent: Nov. 17, 2026

(54) CAST-IN-PLACE ANCHOR

(71) Applicant: BLACK & DECKER INC., New Britain, CT (US)

(72) Inventor: Markus Rompel, Runkel (DE)

(73) Assignee: BLACK & DECKER INC.

( * ) Notice: Subject to any disclaimer, the term of this patent is extended or adjusted under 35 U.S.C. 154(b) by 139 days.

(21) Appl. No.: 18/905,337

(22) Filed: Oct. 3, 2024

(65) Prior Publication Data

US 2026/0085516 A1 Mar. 26, 2026

(30) Foreign Application Priority Data

Sep. 23, 2024 (EP) ..... 24201953

(51) Int. Cl.
*E04B 1/41* (2006.01)

(52) U.S. Cl.
CPC ..... *E04B 1/415* (2013.01); *E04B 1/4114* (2013.01)

(58) Field of Classification Search
CPC ..... E04B 1/415; E04B 1/4114
See application file for complete search history.

(56) References Cited

U.S. PATENT DOCUMENTS 1,285,202 A * 11/1918 Jaques et al. ..... E04B 1/4121 52/707
1,547,169 A * 7/1925 Havemeyer ..... E04B 1/415 52/701
2,277,449 A * 3/1942 Paine ..... E04B 1/415 52/708
2,988,855 A * 6/1961 Asfour ..... E04B 1/415 411/116
3,000,146 A * 9/1961 Rogers ..... E04B 1/4114 52/27
3,597,893 A * 8/1971 Spanel ..... E04B 1/415 248/680
3,599,379 A * 8/1971 Tuska ..... E04B 1/4157 52/707

(Continued)

FOREIGN PATENT DOCUMENTS

DE 102005028840 A1 1/2007
DE 102021108011 A1 10/2022

(Continued)

OTHER PUBLICATIONS

International Search Report dated Nov. 14, 2025 cited in corresponding PCT Application No. PCT/EP2025/075755.

(Continued)

*Primary Examiner* — Jessie T Fonseca
(74) *Attorney, Agent, or Firm* — Dickinson Wright PLLC

(57) ABSTRACT

A cast-in-place anchor including a cavity in which a cable is provided and from within which the cable can be withdrawn through an aperture of the anchor, the anchor further including a retaining portion for resisting complete withdrawal of the cable from within the cavity of the anchor. A method of manufacturing including the steps of providing a retaining portion on a cable to resist complete withdrawal of the cable from within a cavity of a cast-in-place anchor in use; and disposing the cable in the cavity of the cast-in-place anchor, from which cavity the cable can be withdrawn through an aperture of the cast-in-place anchor.

20 Claims, 5 Drawing Sheets

(56) References Cited

U.S. PATENT DOCUMENTS

| | | | | | |
|---|---|---|---|---|---|
| 6,102,607 | A * | 8/2000 | Kintscher | ..... | E04G 21/126 52/587.1 |
| 9,238,155 | B2 * | 1/2016 | Borchardt | ..... | E04G 21/3295 |
| 9,353,535 | B2 * | 5/2016 | Borchardt | ..... | E04G 21/3223 |
| 2006/0242924 | A1 * | 11/2006 | Kwon | ..... | E04B 1/4142 52/707 |
| 2008/0042029 | A1 * | 2/2008 | Reeves | ..... | E04G 21/3276 248/231.91 |
| 2014/0044509 | A1 * | 2/2014 | Pino | ..... | B62D 43/045 414/463 |
| 2015/0096242 | A1 * | 4/2015 | Lin | ..... | F16B 37/00 52/125.5 |

FOREIGN PATENT DOCUMENTS

| | | | | | |
|---|---|---|---|---|---|
| EP | 2025833 | B1 | | 2/2012 | |
| EP | 2224075 | B1 | | 8/2016 | |
| GB | 2307494 | A | * | 5/1997 | ..... E04G 21/142 |
| JP | H0813622 | A | | 1/1996 | |
| JP | H11264198 | A | * | 9/1999 | |
| JP | 2004132090 | A | | 4/2004 | |
| JP | 4615419 | B2 | | 1/2011 | |
| WO | WO-2008090260 | A1 | * | 7/2008 | ..... E04G 21/126 |

OTHER PUBLICATIONS

European Search Report Dated Mar. 19, 2025, cited in corresponding EP Patent Application No. 24201953.7.

* cited by examiner

CAST-IN-PLACE ANCHOR

CROSS-REFERENCE TO RELATED APPLICATIONS

This application claims priority from EP Patent Application No. 24201953.7, filed Sep. 23, 2024, the disclosures of which is incorporated herein by reference in their entirety.

FIELD OF THE INVENTION

The present invention relates to a cast-in-place anchor to a method of manufacturing and to a cast-in-place anchor assembly comprising the cast-in-place anchor.

BACKGROUND OF THE INVENTION

Cast-in-place anchor assemblies are intended to be mounted on a surface on which concrete is to be poured. Once the anchor assembly is located on the surface (which might be a formboard or metal sheet), concrete is poured onto the surface. The wet concrete covers the anchor assembly. Once the concrete is set, the anchor assembly is exposed on an underside of the concrete. The surface on which the concrete was poured is optionally removed to expose the anchor assembly. The anchor assembly is available for suspending objects from the underside of the concrete.

It is desirable to provide an alternative cast-in-place anchor.

BRIEF SUMMARY OF THE INVENTION

According to an aspect of the invention there is provided a cast-in-place anchor including a cavity in which a cable is provided and from within which the cable can be withdrawn through an aperture of the anchor. The anchor further includes a retaining portion for resisting complete withdrawal of the cable from within the cavity of the anchor, wherein optional features thereof are defined in the specification herein and dependent claims.

According to another aspect of the invention there is provided a cast-in-place anchor assembly including a cast-in-place anchor and a support for supporting the cast-in-place anchor on a surface prior to concrete pouring in use.

According to another aspect of the invention there is provided a method of manufacturing including attaching a flange of the cast-in-place anchor to a shaft of the cast-in-place anchor, optionally by welding and/or a screw-fit attachment and providing a plug at an end of the cable and locating the plug in the aperture.

BRIEF DESCRIPTION OF THE DRAWINGS

Examples will now be described in detail with reference to the accompanying drawings in which.

Figure 1:
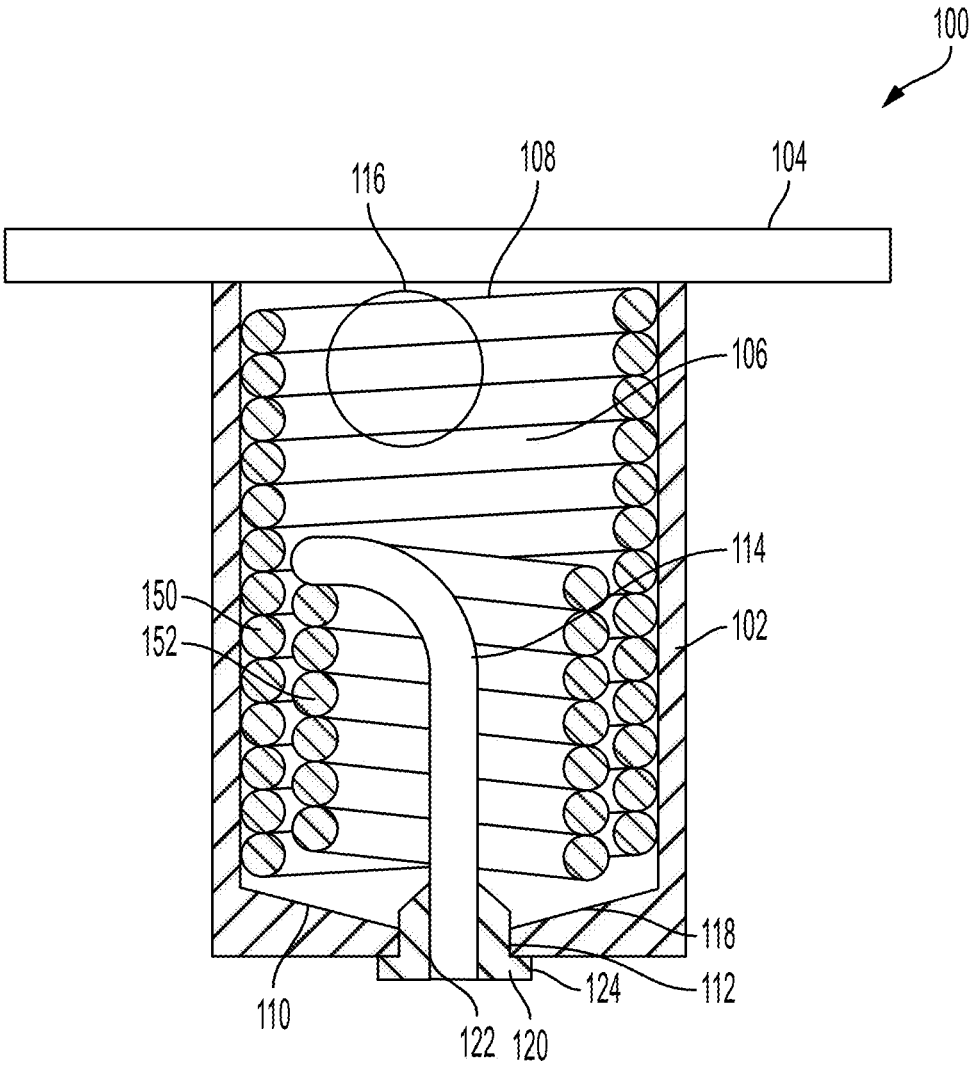
FIG. 1 illustrates a cross-sectional view of a cast-in-place anchor.

The accompanying drawings illustrate various examples. Common reference numerals are used throughout the figures, where appropriate, to indicate similar features.

DETAILED DESCRIPTION OF THE PREFRRED EMBODIMENT

The following description is presented by way of example to enable a person skilled in the art to make and use the invention. The present invention is not limited to the embodiments described herein and various modifications to the disclosed embodiments will be apparent to those skilled in the art.

The present techniques relate to a cast-in-place anchor for suspending objects below concrete. A cast-in-place anchor is locatable on a surface, before wet concrete is poured over the surface and over the cast-in-place anchor. The concrete sets around the cast-in-place anchor, holding it in position. The cast-in-place anchor is thereby able to anchor objects to the concrete. The cast-in-place anchor can form part of a cast-in-place anchor assembly, wherein the cast-in-place anchor assembly comprises a support for supporting the cast-in-place anchor on the surface prior to concrete pouring in use. There are two main types of cast-in-place anchor assemblies. One type is mountable on a formboard, which can be wood. The cast-in-place anchor assembly is fixable to the formboard. For example, the support is configured to be fixable to the formboard by nails. Once the concrete is set, the formboard can be removed, exposing the cast-in-place anchor. Another type is mountable through a hole drilled in sheet metal. For example, the support is configured to be mountable through a hole drilled in sheet metal. A portion of the cast-in-place anchor is accessible from beneath the sheet metal.

In either case, a portion of the cast-in-place anchor is accessible from an underside of the set concrete layer. Typically, the cast-in-place anchor comprises a threaded recess to which a threaded rod can be fixed. The threaded rod extends downwardly from the concrete layer and can be used to support objects beneath the concrete.

The cast-in-place anchor comprises a flange which, after concrete pouring and setting, is embedded within the concrete. Cooperation between the flange and the surrounding concrete prevents the cast-in-place anchor being pulled out of the concrete by a load supported by the cast-in-place anchor.

As an alternative to supporting objects from such a rod, a cable hanging system can be used to support objects from cables. Such cable hanging systems typically require a fastener that will install the wire on the underside of the concrete.

The present techniques relate to a cast-in-place anchor comprising a cavity in which a cable is provided and from within which the cable can be withdrawn through an aperture of the cast-in-place anchor, the cast-in-place anchor further comprising a retaining portion for resisting complete withdrawal of the cable from within the cavity of the cast-in-place anchor. The cable can be partially pulled out through the aperture and used to support a load. Such an arrangement offers a reduction in complexity compared to the current workflow: there is no need for an additional fastener to fix the cable to the underside of the concrete. Accordingly, there can be a reduction in the number of steps needed to install a cable hanging system compared to conventional systems, which can improve the efficiency of installing cable hanging systems.

A cast-in-place anchor according to the present techniques will now be described with reference to the figures. FIG. 1 illustrates a cast-in-place anchor 100. The cast-in-place anchor 100 comprises a generally cylindrical shaft 102 and a flange 104. Both the shaft 102 and the flange 104 comprise metal. This can improve the attachment between the flange 104 and the shaft 102. The flange 104 is attached to the shaft 102 by welding or threading. Securely attaching the shaft 102 to the flange 104 assists in the retention of the shaft 102 in concrete.

The shaft 102 comprises a cavity 106 having an upper end 108 and an interior base 110 opposite the upper end 108. The upper end 108 of the cavity 106 is adjacent the flange 104. The cast-in-place anchor 100 comprises an aperture 112. The aperture 112 is provided in the base 110 of the cavity 106. The aperture 112 is located centrally in the base 110. The base 100 including aperture 112 may be selectively removeable from the shaft 102 via a threaded connection 113 therebetween.

A cable 114 is provided in the cast-in-place anchor 100. The cable 114 is disposed within the cavity 106. The cast-in-place anchor 100 is configured so that the cable 114 can be partially withdrawn from the cavity 106 through the aperture 112. The cable 114 is a flexible metal cable. Providing the cable 114 within the cast-in-place anchor 100 enables quicker attachments of objects to the cast-in-place anchor 100. Providing the cable 114 within the cast-in-place anchor 100 avoids the need to subsequently attach a cable to the cast-in-place anchor 100 or to another element fixed to the cast-in-place anchor 100.

The cast-in-place anchor 100 comprises a retaining portion 116 for resisting complete withdrawal of the cable 114 from within the cavity 106 of the cast-in-place anchor 100. The retaining portion 116 is wider than the aperture 112 so that the retaining portion 116 will not pass through the aperture 112. The retaining portion 116 is fixed to an end of the cable 114. The retaining portion 116 is a generally spherical element made of metal.

The cable 114 is coiled inside the cavity 106 of the shaft 102. Coiling the cable 114 inside the cavity 106 is space-efficient. Thus, a greater length of cable 114 can fit within a given cavity size where the cable 114 is coiled, compared to a random insertion of the cable 114 into the cavity 106. As illustrated in the figures, the cable 114 is coiled inside the cavity 106 of the shaft 102 in a double coil. That is, a primary coil 150 is arranged with an outer diameter that approximates an inner diameter of the cavity 114. A secondary coil 152 is arranged inside the primary coil 150. This arrangement of multiple coils enables a greater density of cable to be provided within the cavity 114.

Coiling the cable 114 inside the cavity 106 enables the cable 114 to be withdrawn more smoothly and/or consistently from the cavity 106, compared to a random insertion of the cable 114 into the cavity 106.

The cast-in-place anchor 100 illustrated in FIG. 1 comprises a plug 120. The plug 120 is provided at an end of the cable 114 distal from the end at which the retaining portion 116 is located. The plug 120 is sized and/or configured to fit within the aperture 112. The plug 120 is a friction fit in the aperture 112. The plug 120 is formed from an elastomeric material such as rubber, enabling the plug 120 to be releasably engaged with the aperture 112.

The plug 120 comprises a channel 122 for receiving the end of the cable 114. Providing the channel 122 in the plug 120 can simplify the engagement of the end of the cable 114 with the plug 120. The end of the cable 114 is engaged with the channel 122 in the plug 120 by a friction fit. The elastomeric material from which the plug 120 is formed enables a secure friction fit of the end of the cable 114 in the channel 122.

The plug 120 is accessible from an exterior of the shaft 102 of the cast-in-place anchor 100. As can be seen from FIG. 1, the plug 120 protrudes partially through the aperture 112. An annular lip 124 of the plug 120 is seated against an external surface of the shaft 102 adjacent the aperture 112. The provision of the annular lip 124, being wider than the aperture 112, prevents the plug 120 from being pushed all the way through the aperture 112. Thus, this arrangement of the plug 120 can ensure that the plug 120, and hence the cable 114, remains accessible from the outside of the shaft 102.

Locating the plug 120 in the aperture 112 can resist or avoid the ingress of wet concrete into the cavity 106 during concrete pouring and setting. Furthermore, a bottom most surface of the plug 120 or annular lip 124 can be recessed in the base 110 so that an outer and under surface of base 110 outside the anchor is the lowest portion of the anchor. In this arrangement, the plug does not extend downward proud of the bottom surface of the anchor base 110.

The base 110 of the cavity 106 is angled towards the aperture 112. The base 110 has a generally conical shape. That is, the cavity 106 comprises a generally conical interior base 110. The (notional) apex of the conical interior base 110 is at the centre of the aperture 112. The aperture 112 is located along a notional axis extending along the length of the cast-in-place anchor 100 (i.e. a vertical axis, in the orientation of FIG. 1).

The cable 114 can be partially withdrawn through the aperture 112, so that the cable 114 hangs from the cast-in-place anchor 100. The retaining portion 116 resists complete withdrawal of the cable 114 from within the cavity 106, allowing a load to be anchored to the cast-in-place anchor 100 via the cable 114. The process of partially withdrawing the cable 114 from within the cavity 106 will now be described.

Figure 2:
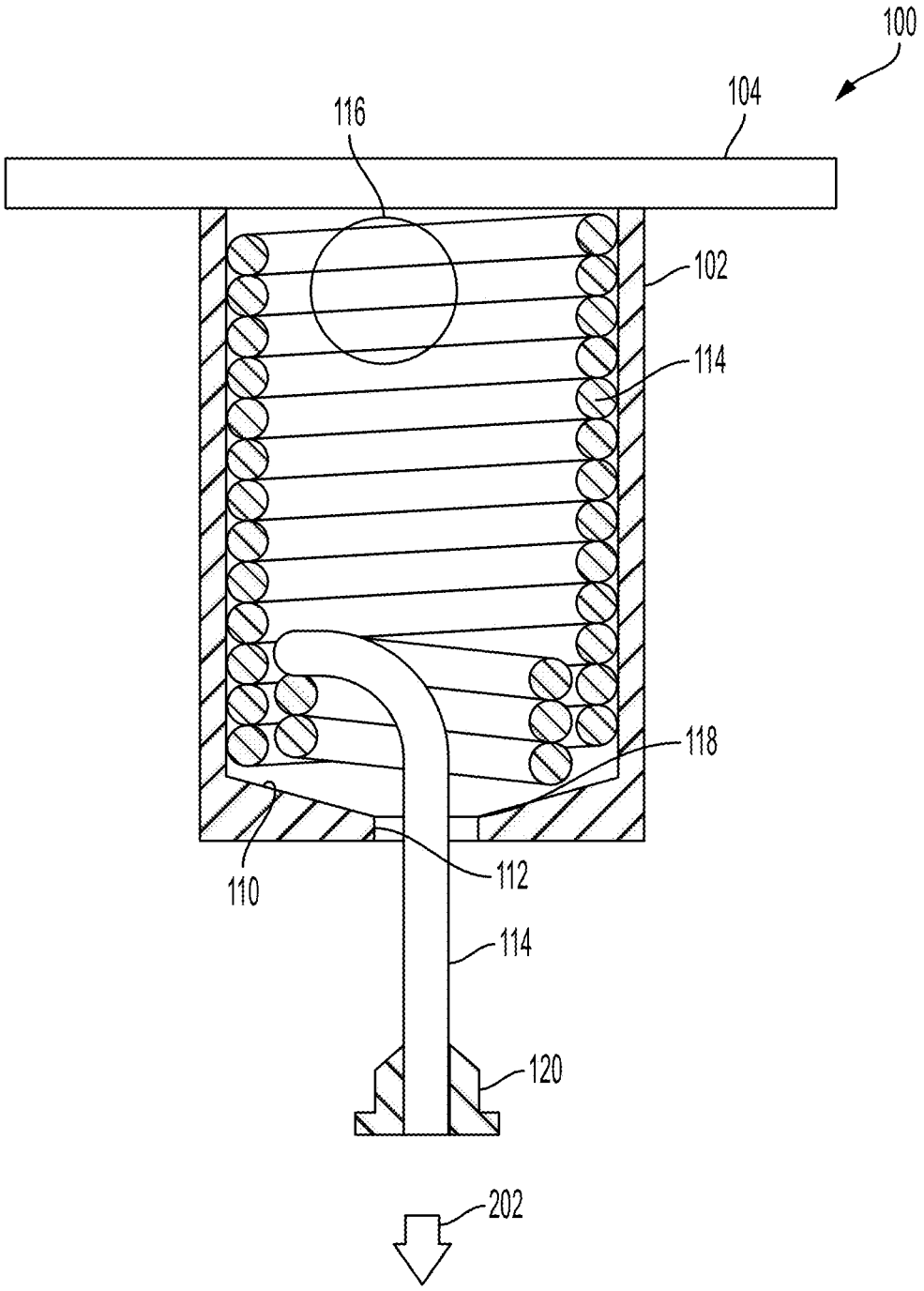
FIG. 2 illustrates the cast-in-place anchor of FIG. 1 as a cable is partially withdrawn through an aperture of the cast-in-place anchor.

Referring to FIG. 2, the plug 120 can be grasped by a user, and pulled downwardly (in the orientation of FIG. 2) away from the shaft 102. In use, the lower outer surface of the shaft 102, and therefore the plug 120, will be accessible from an underside of a concrete layer. Pulling the plug 120 downwardly pulls out the cable 114 from within the cavity 106, since the plug 120 is engaged with an end of the cable 114.

FIG. 2 shows the arrangement when the plug 120 is removed from the aperture 112 and starts to be pulled downwardly, in the direction of the arrow 202. The cable 114 within the cavity 106 uncoils as the cable 114 is withdrawn through the aperture 112. The conical interior base 110 helps guide the cable 114 towards the aperture 112 and reduces the chances of the cable 114 snagging on a sharp edge within the cavity 106 and/or becoming tangled within the cavity 106. The coiling of the cable 114 assists the withdrawal of the cable 114 from the cavity 106 without the cable 114 becoming tangled.

Figure 3:
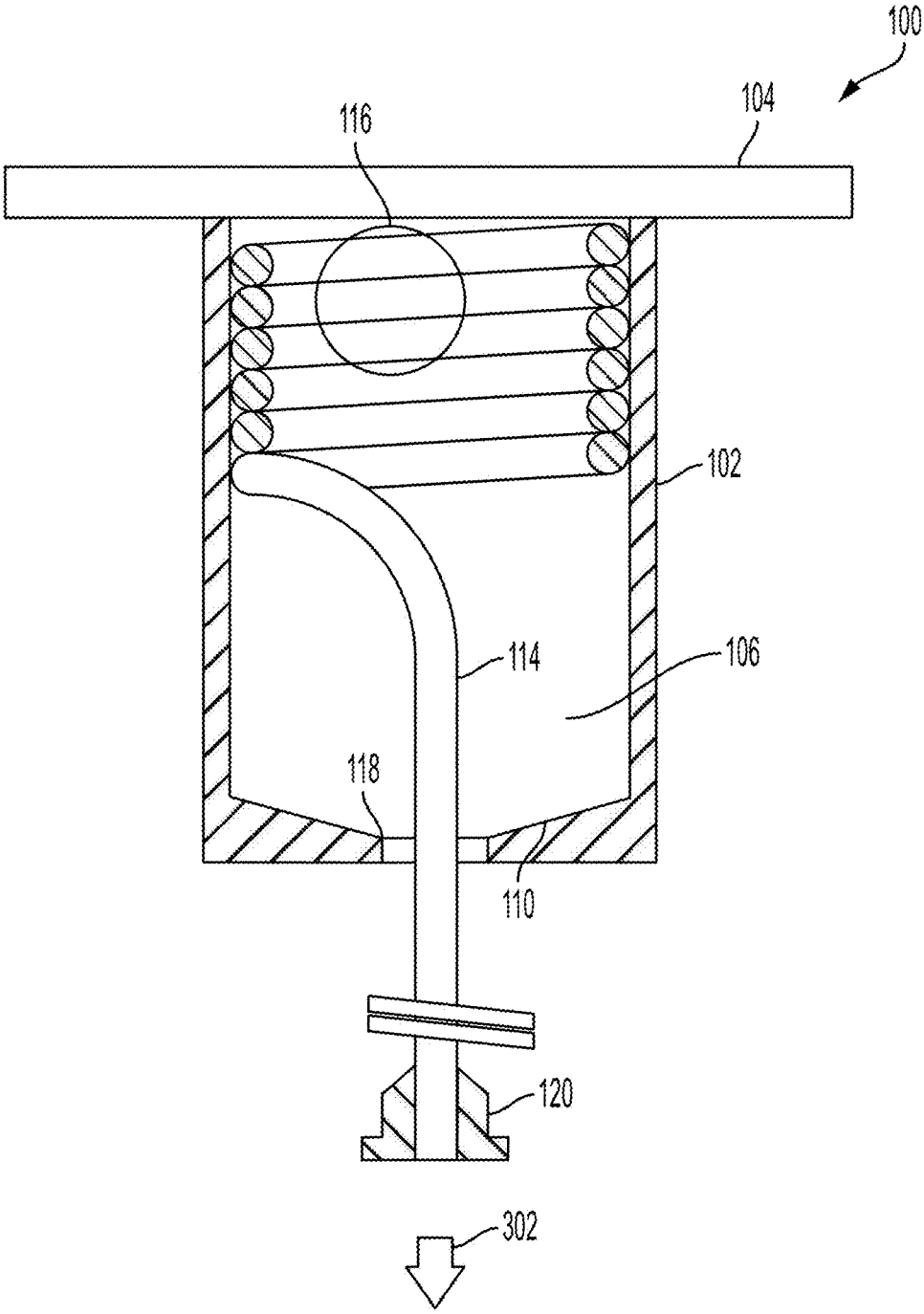
FIG. 3 illustrates the cast-in-place anchor of FIG. 2 as a greater length of cable is withdrawn through the aperture of the cast-in-place anchor.

As the cable 114 is withdrawn from the cavity 106, the secondary (inner) coil 152 unwinds first (compare FIG. 1 and FIG. 2). As the cable 114 continues to be withdrawn, the secondary (inner) coil 152 is fully unwound and the primary (outer) coil 150 starts to unwind. FIG. 3 illustrates the configuration of the cast-in-place anchor 100 when the cable 114 has been withdrawn in the direction of the arrow 302 to such an extent that the primary (outer) coil 150 is unwound approximately halfway.

Figure 4:
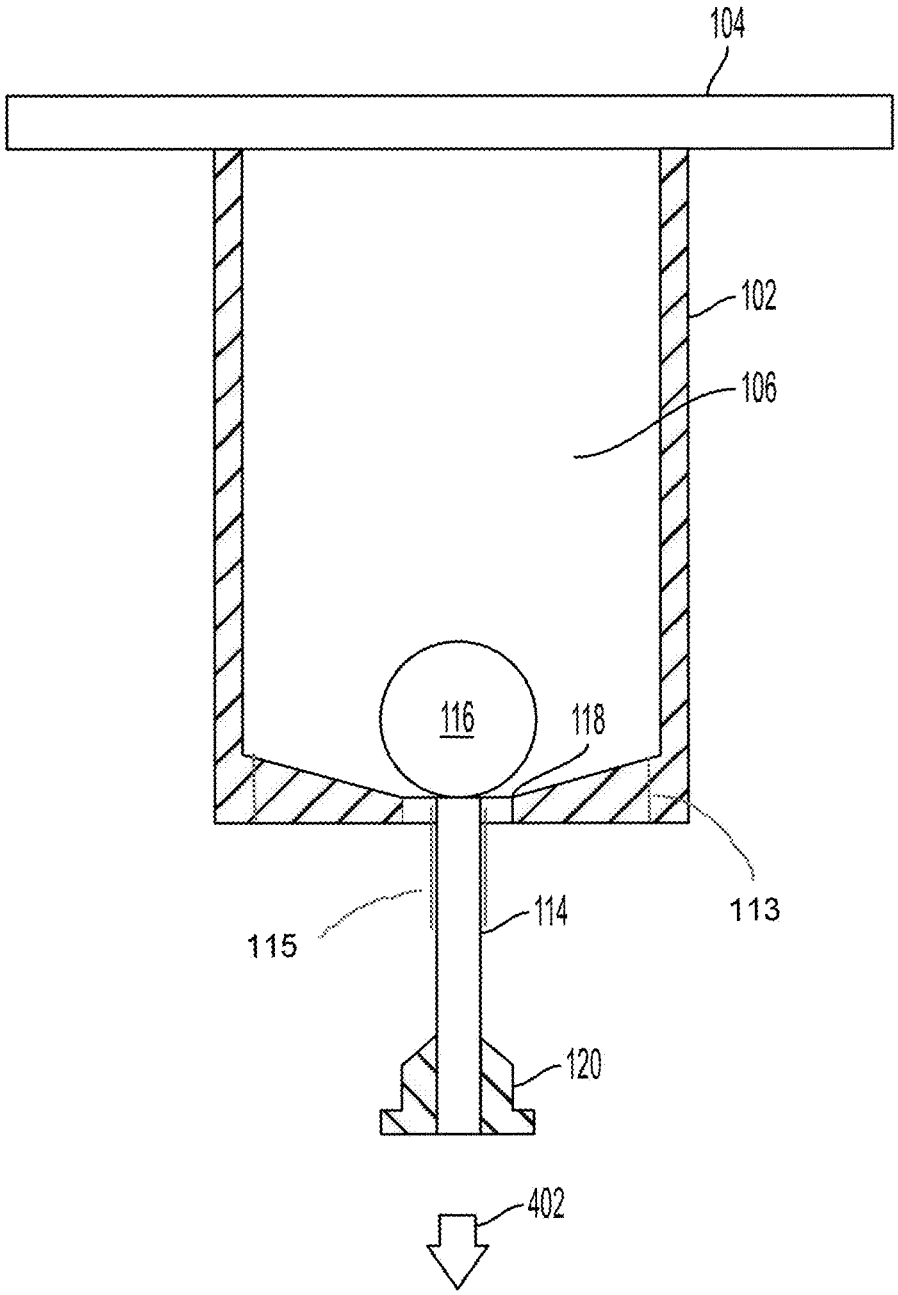
FIG. 4 illustrates the cast-in-place anchor of FIG. 3 as the cable is withdrawn to its fullest extent through the aperture of the cast-in-place anchor.

FIG. 4 illustrates the configuration when the cable 114 is withdrawn to its fullest extent (in the direction of the arrow 402) from the cavity 106 of the shaft 102. The cable 114 hangs below the cast-in-place anchor 100. The generally spherical retaining portion 116 attached to the end of the cable 114 is seated against a seat 118. The seat 118 comprises an annular portion of the base 110 surrounding the aperture 112. Providing a generally spherical retaining portion 116 enables the retaining portion 116 to more securely be seated in the seat 118. Since the retaining portion 116 is larger than the aperture 112, the retaining portion 116 cannot pass through the aperture 112. The end of the cable 114 to which the retaining portion 116 is fixed is therefore retained relative to the cavity 106. Hence, a load supported by the cable 114 is anchored to the cast-in-place anchor 100.

Since the aperture 112 is central to the base 110, the load is supported centrally from the cast-in-place anchor 100. This arrangement enables accurate determination of the support point, and so enables optimal placement of the cast-in-place anchor 100.

The cable 114 is of a fixed length but can be cut to a desired length once fully extended from the cast-in-place anchor 100. Indicia or some other visual indicator 115 (e.g., a ring of colored paint or colored tape) may be placed on cable 114 below and adjacent retaining portion 116 so that as retaining portion 116 sits on aperture 112, the indicator 115 is visible from outside the anchor housing and a user is assured that the full length of cable 114 has been retracted and retaining portion 116 is properly seated in aperture 112. A small kink or impression in the cable may also be employed as an indicator. For example, before assembly, the end of cable 114 including retaining portion 116 may be dipped in paint or other coloring or placed in a crimper to create a non-destructive visual bend or kink etc.

The cast-in-place anchor discussed herein can be used with conventional cast-in-place anchor assembly supports. The cast-in-place anchor described herein can be used with a support for nailing to a formboard before concrete pouring. An example of such a support forms part of the DEWALT® WOOD KNOCKER II+ cast-in-place anchor assembly and is described in EP 3208398 B1, the entire contents of which are incorporated herein by reference. The cast-in-place anchor described herein can be used with a support for supporting the cast-in-place anchor on a corrugated metal surface. An example of such a support forms part of the DEWALT® BANG IT cast-in-place anchor assembly and is described in EP 3415699 A1, the entire contents of which are incorporated herein by reference.

Figure 5:
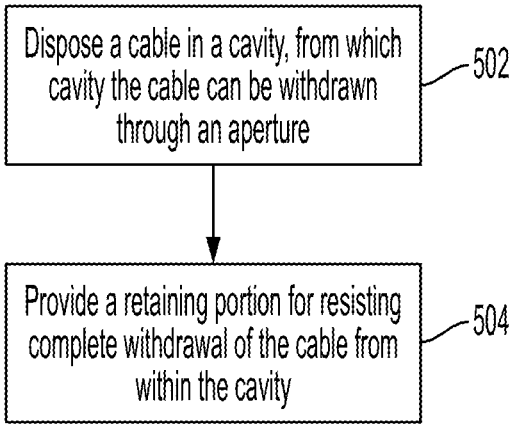
FIG. 5 is a flow chart of a method of manufacturing.

A method of manufacturing will now be described, with reference to FIG. 5. The method including:

disposing 502 a cable 114 in a cavity 106 of a cast-in-place anchor 100, from which cavity 106 the cable 114 can be withdrawn through an aperture 112 of the cast-in-place anchor 100;

providing 504 a retaining portion 116 of the cast-in-place anchor 100 for resisting complete withdrawal of the cable 114 from within the cavity 106 of the cast-in-place anchor 100.

Such steps can be implemented in either order.

Providing the cable 114 in the cavity 106 avoids the need for a separate step of attaching the cable 114 to the cast-in-place anchor 100 following concrete casting.

The method further comprises fixing the retention portion 116 to the cable 114. The method comprises fixing the retention portion to an end of the cable 114. The method comprises welding the retention portion 116 to the cable 114. This provides a secure attachment between the cable 114 and the retention portion 116, enabling a load to be anchored to the cast-in-place anchor 100 via the cable 114.

The method comprises coiling the cable 114 in the cavity 106. The method comprises coiling the cable 114 in the cavity 106 in a double coil.

The method comprises providing a plug 120 at an end of the cable 114 distal from the retaining portion 116. The method comprises engaging the end of the cable 114 with a channel 122 in the plug 120. The method comprises engaging the plug 120 with the aperture 112. Providing the plug 120, to which the cable 114 is engaged, in the aperture 112 permits ease of access to the cable 114 following a concrete pouring and setting process.

The method comprises forming the shaft 102 of the cast-in-place anchor 100 in a casting process. The method comprises forming the aperture 112 in the cast-in-place anchor 100 in a casting process. The method comprises forming the conical interior base 110 of the cavity 106 in a casting process.

The method comprises affixing the flange 104 to the shaft 102 by welding. Welding the flange 104 and the shaft 102 together forms a strong join between the flange 104 and the shaft 102. The shaft 102 comprises an upper end 108 of the cavity 106. The upper end 108 of the cavity 106 is open for receiving the cable 114 into the cavity 106. Affixing the flange 104 to the shaft 102 covers the upper end 108. Affixing the flange 104 to the shaft 102 can restrict or prevent ingress of wet concrete into the cavity 106 during a concrete pouring and setting process.

The method comprises affixing the flange 104 to the shaft 102 after the cable 114 and retention portion 116 are located in the cavity 106.

The method comprises engaging the cast-in-place anchor 100 with a support for supporting the cast-in-place anchor 100 on a surface prior to concrete pouring in use.

It will be appreciated that whilst various aspects and embodiments have heretofore been described, the scope of the present invention is not limited thereto and instead extends to encompass all arrangements, and modifications and alterations thereto, which fall within the spirit and scope of the appended claims.

The flange 104 need not be welded to the shaft 102. The flange 104 can additionally or alternatively be attached to the shaft 102 by a screw fit engagement. The flange 104 can be welded to the shaft 102 after the flange 104 and the shaft 102 are screwed together, to improve the strength of the join between the flange 104 and the shaft 102.

The flange 104 and the shaft 102 need not be of the same material, but can each be made from any suitable material, for example from a group of materials comprising metal, plastic and composite materials.

The cable need not be metal, or need not be wholly metal. The cable can comprise a fibrous material. The cable can comprise a polymeric material such as a polymer. A polymeric cable can have an improved strength-to-weight ratio compared to some metal cables. The cable can comprise a twisted cable. In some examples, a twisted cable can withstand greater loads than a non-twisted cable.

The retention portion 116 need not be welded to the cable 114. The retention portion 116 can, in other examples, be clamped or crimped to the cable 114. The retention portion 116 can alternatively be unitary with the cable 114. The retention portion 116 need not comprise metal. The retention portion 116 may comprise a polymer or other type of plastic.

The retention portion 116 need not be generally spherical. The retention portion 116 can be of any suitable shape. Providing the retention portion 116 with a curved outer surface is advantageous since this configuration assists with securely seating the retention portion 116 in the seat 118.

The seat 118 may comprise one or more gripping features, to assist in the retention of the retention portion 116. Such a gripping feature can comprise one or more ridges provided in the base 110. The ridges may be formed in concentric circles surrounding the aperture 112. The gripping feature may be of a different material to the base 110. For example, the gripping feature comprises a portion of elastomeric material surrounding the aperture 112 for resisting movement of the retention portion 116 once seated in the seat 118.

The cavity 106 has been described as having a conical interior base 110. A conical interior base 110 is not necessary in all examples. The base 110 can comprise a non-conical angled portion. The angle of the base 110 need not have a linear gradient. The base 110 need not be angled. In some examples the base 110 comprises an indent or recess adjacent the aperture 112 for more securely retaining the retention portion 116 in the seat 118.

The retention portion 116 need not have a fixed width. The retention portion 116 can be configured to have a first configuration in which it is insertable through the aperture 112 and a second configuration in which it is unable to be withdrawn through the aperture 112. For example, in the first configuration, the retention portion 116 can have a width that is less than a width (or diameter) of the aperture 112. In the second configuration, the retention portion 116 can have a width that is greater than the width (or diameter) of the aperture 112.

An example retention portion 116 comprises a camming device, such as a spring-loaded camming device. Such a camming device comprises a first rotatable cam and a second rotatable cam which can be configured to rotate in a different direction to the first rotatable cam. As the cams rotate, the outer dimension of the retention portion 116 changes. The cams are rotatable to the first configuration and insertable through the aperture 112, then rotatable to the second configuration for restricting withdrawal through the aperture 112. In some examples, the camming device comprises a resilient element configured to urge the camming device towards the second configuration. The resilient element can be a spring. In some implementations the camming device is based on similar principles to camming devices used by climbers for locating in crevices in rock faces.

Another example retention portion 116 comprises an expandable portion. The expandable portion is configured to expand to transition the retention portion 116 from the first configuration towards the second configuration. The expandable portion can be configured to expand under the action of a resilient element such as a spring, or under the action of a rotating screw. In some implementations, the retention portion 116 comprising an expandable portion takes the form of a cavity wall fixing. Such a retention portion 116 is insertable through the aperture 112, and expandable so as to restrict withdrawal of the retention portion 116 through the aperture 112.

The retention portion 116 need not be movable relative to the shaft 102 or flange 104. In some examples, the retention portion 116 is fixedly attached to an attachment portion of the cast-in-place anchor 100. For example, the retention portion 116 can be tied, welded or screw fit to the attachment portion of the cast-in-place anchor 100. In some examples, the flange 104 comprises the attachment portion. In other examples, the shaft 102 comprises the attachment portion. Preferably, the attachment portion of the cast-in-place anchor 100 faces an interior of the cavity 106.

The plug 120 need not be formed from or comprise an elastomeric material. In some examples, the plug 120 comprises any other suitable resilient material, for example rubber. The plug 120 need not comprise a resilient material.

The channel 122 in the plug 120 is, in some examples, a blind channel.

In some examples, the plug 120 comprises a resilient lip on an outer surface thereof that is insertable through the aperture 112. The resilient lip is configured to releasably snap fit past an edge of the aperture 112. The provision of the resilient lip can assist in the retention of the plug 120 in the aperture 112 until it is desirable to remove the plug 120 from the aperture 112.

In other examples, the plug 120 is a screw fit into the aperture 112. For example, the plug 120 can comprise an outer threaded portion for cooperative engagement with an inner threaded portion in the aperture 112.

In some examples the plug 120 is unitary with the cable 114. This arrangement avoids the need to provide a channel 122 within the plug 120 and subsequently to engage the cable 114 in the channel 122.

The shaft 102 need not be formed in a casting process. Alternatively, the shaft 102 can be milled from a block of material such as metal. The angled base 110 can be formed by milling. The aperture 112 in the base 110 of the shaft 102 is, in some examples, formed by drilling.

The cast-in-place anchor 100 need not be provided with a double coil of cable 114. In some examples, there is only a single coil of cable 114 within the cavity 106. In other examples, there are three or more coils of cable 114 within the cavity 106.

What is claimed is:

1. A cast-in-place anchor comprising:

a shaft defining a cavity extending from an upper end to a base;

a cable provided within the cavity and from within which the cable can be withdrawn through an aperture provided in the base;

a retaining portion disposed at a first end of the cable for resisting complete withdrawal of the cable from within the cavity; and a plug disposed at a second end of the cable and configured to fit within and close the aperture.

2. The cast-in-place anchor of claim 1, wherein the retaining portion is fixed to the cable or in which the retaining portion is formed unitarily with the cable.

3. The cast-in-place anchor of claim 1, wherein the retaining portion is larger or wider than the aperture.

4. The cast-in-place anchor of claim 1, wherein the retaining portion is configured to change between a first configuration in which it is insertable through the aperture and a second configuration in which it is unable to be withdrawn through the aperture.

5. The cast-in-place anchor of claim 1, wherein the retaining portion fixably couples part of the cable to part of the cast-in-place anchor.

6. The cast-in-place anchor of claim 1, wherein the plug is fixed to the cable or in which the plug is unitarily formed with the cable.

7. The cast-in-place anchor of claim 1, further compris ing a flange extending outwardly from the shaft adjacent to the upper end of the cavity.

8. The cast-in-place anchor of claim 7, wherein the shaft is attached to the flange by one or more of screw fitting and welding.

9. The cast-in-place anchor of claim 1, wherein the cable is coiled within the cavity.

10. The cast-in-place anchor of claim 1, wherein the base of the cavity is angled towards the aperture, and wherein the aperture is located on a notional axis extending along the length of the cast-in-place anchor.

11. A cast-in-place anchor assembly comprising a cast-in-place anchor according to claim 1, and a support for supporting the cast-in-place anchor on a surface prior to concrete pouring in use.

12. The cast-in-place anchor of claim 1, further including a visual indicator near the retaining portion, the visual indicator extending through the aperture when the retaining portion engages the aperture.

13. The cast-in-place anchor of claim 1, further including a threaded connection between the base and the shaft to enable a user to separate the base from the shaft.

14. The cast-in-place anchor of claim 1, wherein the plug is comprised of an elastomeric material.

15. The cast-in-place anchor of claim 1, wherein the plug includes an annular lip seated against an external surface of the shaft adjacent to the aperture.

16. A method of manufacturing comprising:

providing a retaining portion on a first end of a cable to resist complete withdrawal of the cable from within a cavity of a cast-in-place anchor in use;

disposing the cable in the cavity of the cast-in-place anchor, from which the cable can be withdrawn through an aperture of the cast-in-place anchor; and providing a plug on a second end of the cable and locating the plug within the aperture for closing the aperture.

17. The method of claim 16, further including the step of attaching a flange of the cast-in-place anchor to a shaft of the cast-in-place anchor.

18. The method of claim 16, further including the step of providing a visual indicator near the retaining portion which protrudes through the aperture and is visually observable by a user from outside of the cavity.

19. The method of claim 16, further including the step of dipping the first end of the cable in a colored paint.

20. The method of claim 16, further including the step of providing a threaded connection between a base and a shaft of the cast-in-place anchor and the step of removing the base from the shaft.

* * * * *